US008777571B1

(12) United States Patent
Liang

(10) Patent No.: US 8,777,571 B1
(45) Date of Patent: Jul. 15, 2014

(54) TURBINE AIRFOIL WITH CURVED DIFFUSION FILM COOLING SLOT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 442 days.

(21) Appl. No.: 13/316,485

(22) Filed: Dec. 10, 2011

(51) Int. Cl.
*F01D 5/20* (2006.01)

(52) U.S. Cl.
USPC ..... 416/97 R

(58) Field of Classification Search
USPC .... 415/115; 416/97 R, 97 A, 96 R, 96 A, 232
See application file for complete search history.

(56) References Cited

U.S. PATENT DOCUMENTS

| | | | | |
|---|---|---|---|---|
| 6,994,521 | B2 * | 2/2006 | Liang | 416/97 R |
| 2003/0007864 | A1 * | 1/2003 | Shelton et al. | 415/115 |
| 2005/0281675 | A1 * | 12/2005 | Liang | 416/97 R |
| 2007/0128029 | A1 * | 6/2007 | Liang | 416/97 R |
| 2009/0196737 | A1 * | 8/2009 | Mitchell | 415/115 |
| 2010/0040478 | A1 * | 2/2010 | Abdel-Messeh et al. | 416/97 R |
| 2010/0129231 | A1 * | 5/2010 | Brittingham et al. | 416/97 R |
| 2011/0097188 | A1 * | 4/2011 | Bunker | 415/1 |

* cited by examiner

*Primary Examiner* — Edward Look
*Assistant Examiner* — Danielle M Christensen
(74) *Attorney, Agent, or Firm* — John Ryznic

(57) ABSTRACT

An air cooled turbine airfoil with a leading edge region having rows of diffusion slots opening onto the airfoil surface. Each diffusion slot is connected to a plurality of metering and diffusion holes that meter the cooling air flow and provide for a first diffusion of the cooling air. The metering holes and diffusion holes are angled in order to improve the cooling effectiveness of the passages. The metering and diffusion holes and diffusion slots are formed from a metal printing process that can produce features that cannot be formed from an investment casting process that uses a ceramic core.

5 Claims, 4 Drawing Sheets view A-A
Prior Art view B-B
Prior Art

TURBINE AIRFOIL WITH CURVED DIFFUSION FILM COOLING SLOT

CROSS-REFERENCE TO RELATED APPLICATIONS

None.

GOVERNMENT LICENSE RIGHTS

None.

BACKGROUND OF THE INVENTION

1. Field of the Invention

The present invention relates generally to a gas turbine engine, and more specifically to an air cooled turbine airfoil with leading edge film cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

The leading edge of the airfoil is exposed to the highest gas flow temperature and therefore requires the most amount of cooling. FIGS. 1 and 2 shows a prior art turbine blade with the leading edge region being cooled using a showerhead arrangement of film cooling holes 11 and two rows of gill holes (14). Cooling air is delivered to a supply channel and flows through a row of metering and impingement holes 13 to produce impingement cooling on the backside surface of the leading edge wall. The spent impingement cooling air then flows through the film cooling holes and gill holes to provide a layer of film cooling air on the outer surface of the leading edge region.

The showerhead film cooling holes 11 are supplied with cooling air from a common impingement channel (12) and discharged at various gas side pressures. Because of this prior art design, the cooling flow distribution and pressure ratio across the showerhead film holes for the pressure and suction side film rows is predetermined by the impingement channel pressure. Also, the standard film holes pass straight through the airfoil wall at a constant diameter and exit the airfoil at an angle to the surface. Some of the coolant is subsequently injected directly into the mainstream gas flow causing turbulence, coolant dilution and loss of downstream film cooling effectiveness. And, the film hole breakout on the airfoil surface may induce stress issues in the blade cooling application.

The prior art blade includes three rows of film holes in the showerhead arrangement. The middle row of film holes is positioned at the airfoil stagnation point where the highest heat loads is located on the airfoil leading edge region. Film cooling holes for each film row are inclined at 20 to 35 degrees toward the blade tip as seen in FIG. 3. A major disadvantage of this prior art design is an over-lapping of film cooling air ejection flow in a rotational environment (in a rotor blade) and low through-wall convection area as well as heat transfer augmentation. This prior art film cooling hole arrangement and design results in the appearance of hot streaks 16 on the airfoil surface because the cooling air flow from the middle row flows over the film cooling holes on the outer rows without flow over the space between adjacent film holes in the same row as seen in FIG. 4.

The prior art blade with showerhead film cooling holes is formed by an investment casting process that uses a ceramic core to form the internal cooling air passages and features. The film cooling holes are then drilled into the solid metal blade using a process such as laser drilling or EDM drilling. Because of the limitations of the ceramic core is forming cooling air passages and features, hole diameters are limited to no smaller than around 1.3 mm because the ceramic piece would break when the liquid metal flows around the ceramic core.

BRIEF SUMMARY OF THE INVENTION

An air cooled turbine airfoil, such as a rotor blade or a stator vane, with a leading edge region having a number of rows of metering and diffusion holes that open into rows of diffusion slots that open onto the airfoil surface. Each diffusion slot is connected to a number of metering and diffusion holes that are formed by a metering inlet hole connected to a first diffusion hole that are non-parallel to one another in order to produce a momentum change in the cooling air flow.

The first diffusion holes are angled upward and open into the diffusion slots that are separated by ribs that are also angled in a radial upward direction of the airfoil.

The airfoil with the leading edge region metering and diffusion cooling holes and slots are formed by a metal printing process that can produce cooling air holes and features too small or too complex to be formed by the investment casting process that uses a ceramic core.

DETAILED DESCRIPTION OF THE INVENTION

The present invention is a turbine airfoil, such as a rotor blade or a stator vane, with a leading edge region cooling circuit that includes multiple diffusion slots and holes with curved metering inlet holes that feed the diffusion slots and holes. The cooling air features of the present invention are produced using a metal printing process developed by Mikro Systems, Inc. of Charlottesville, Va. which can print a metal part with very small cooling air holes that cannot be formed from a ceramic core in investment casting. The metal printing process can also produce a porous metal part in which air can flow through the metal part from one side to the other side.

Figure 1:
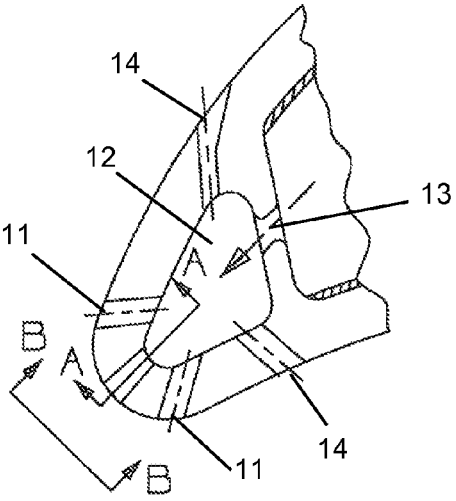
FIG 1 Prior Art
FIG. 1 shows a cross section top view of a leading edge region of the blade with an arrangement of film cooling holes and gill holes for a prior art blade.
Figure 2:
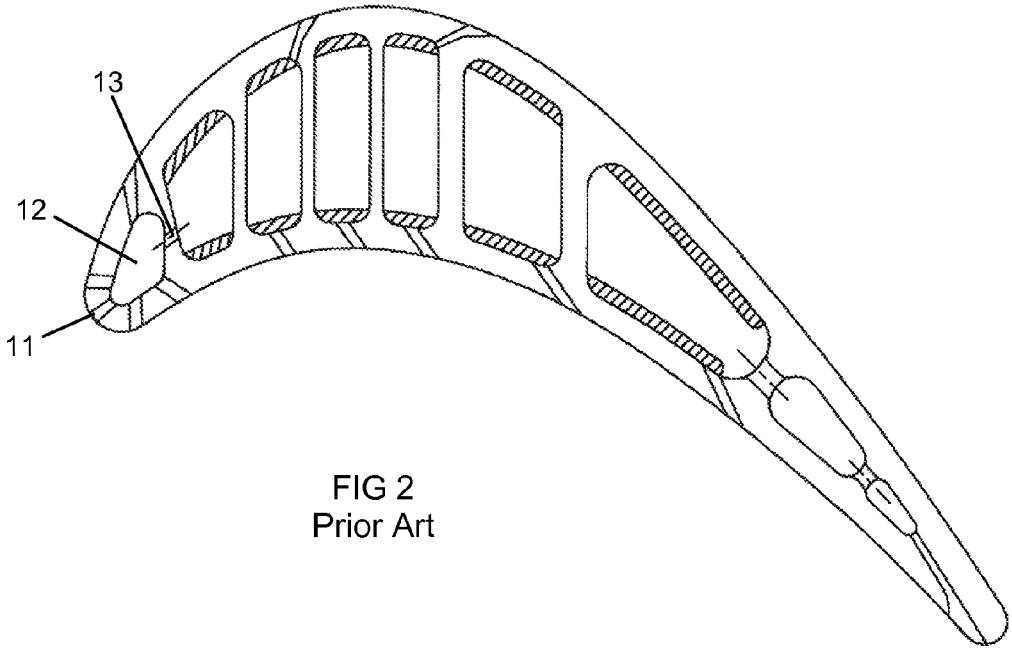
FIG 2 Prior Art
FIG. 2 shows a cross section top view of the prior art blade with a cooling circuit and the leading edge region cooling circuit of FIG. 1.
Figure 3:
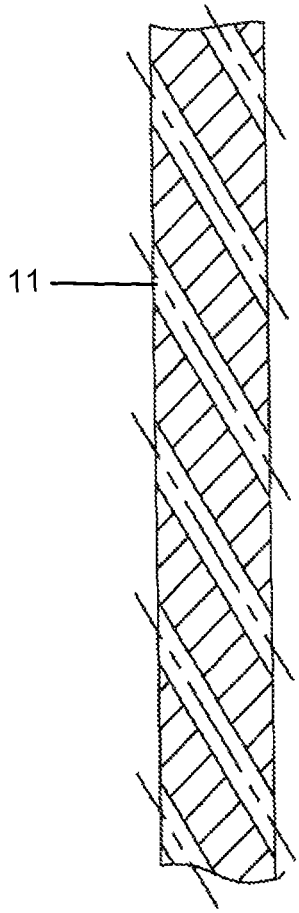
FIG. 3 shows a cross section side view through a row of film cooling holes in the leading edge region of the FIG. 1 blade.
Figure 4:
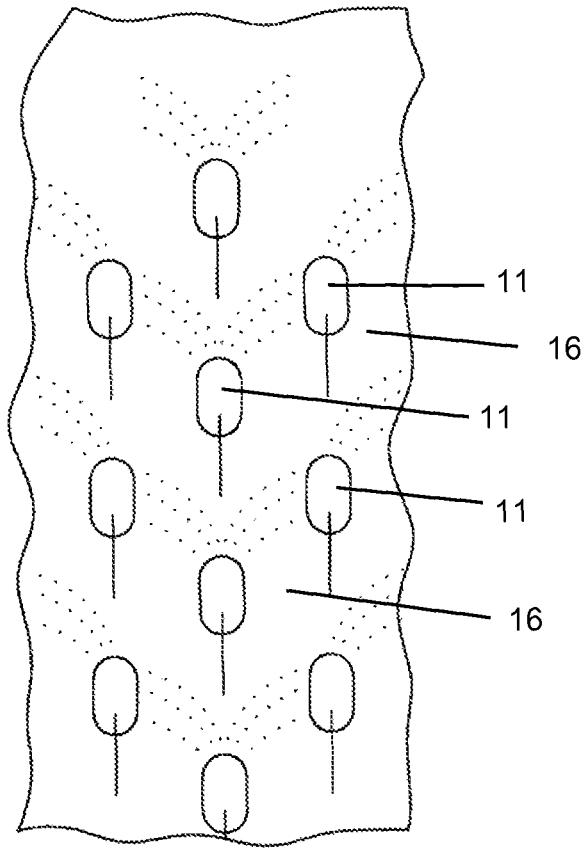
FIG. 4 shows a front view of the showerhead arrangement of film cooling holes of FIG. 1 with the resulting overlapping flow of cooling air for a blade of the prior art FIG. 1.
Figure 5:
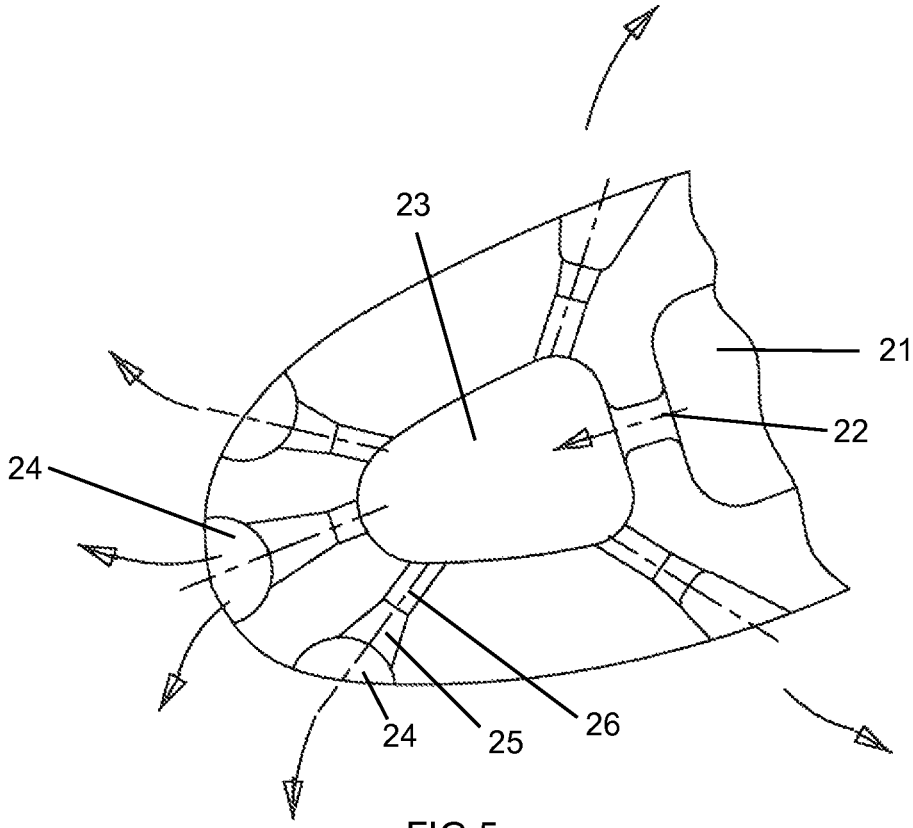
FIG. 5 shows a cross section top view for a leading edge region of an airfoil with a multiple diffusion curved metering film cooling hole design of the present invention.
Figure 6:
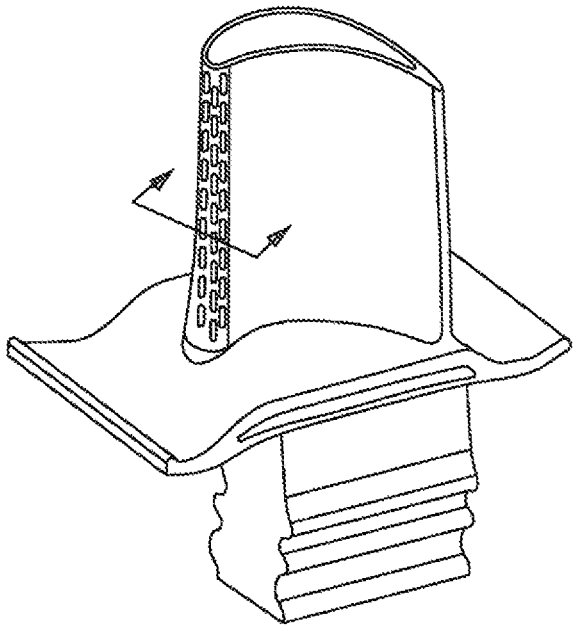
FIG. 6 shows an isometric view of a turbine rotor blade with the leading edge cooling circuit of the present invention.

FIG. 5 shows a leading edge region with the cooling circuit of the present invention. The airfoil in this embodiment is a rotor blade with a cooling air supply channel 21, and a row of metering and impingement holes 22 that open into a leading edge region impingement channel or cavity 23. A showerhead arrangement of film cooling holes and gill holes are connected to the impingement cavity 23 and open onto the external surface of the airfoil. FIG. 6 shows an isometric view of the blade with the diffusion slots 24 opening onto the leading edge region of the blade.

Each of the multiple diffusion with curved metering holes of the present invention includes a metering inlet hole 26 of a constant flow area followed by a first diffusion hole having a conical cross section flow area and a second diffusion section that forms a diffusion slot 24 that opens onto the airfoil surface.

Figure 7:
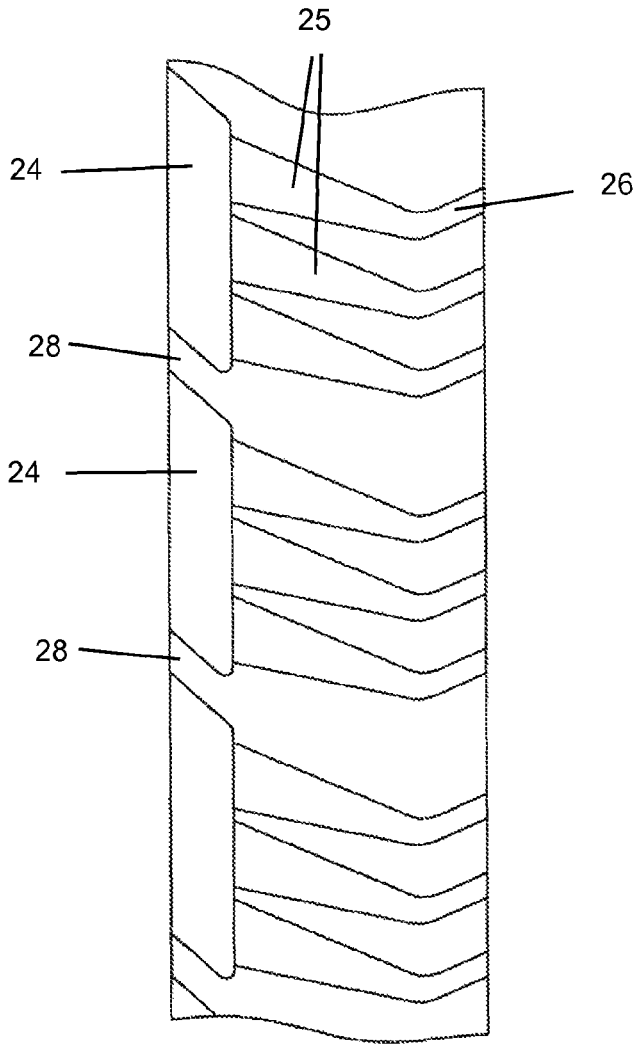
FIG. 7 shows a cross section side view of a row of the multiple diffusion curved metering film cooling holes of the present invention.

FIG. 7 shows a side view of one of the rows of holes and slots of the FIG. 5 embodiment. The inlet metering hole 26 opens into the first diffusion hole 25 and forms a curved or angled flow path for the cooling air. The first diffusion section is a conical shaped hole that increases in flow area in the flow direction of the cooling air to produce diffusion of the cooling air flow. A plurality of these inlet metering holes 26 and first diffusion holes 25 open into a common diffusion slot 24 as seen in FIG. 7. In other embodiments, more of less than three metering hole and first diffusion holes can open into one common diffusion slot 24. The diffusion slots 24 are separated by ribs 28 that are angled in a radial upward direction of the blade to discharge the cooling air in a radial upward direction. The diffusion slots 24 are tall and narrow and extending in a radial or spanwise direction of the blade. Adjacent rows of diffusion slots 24 are offset or staggered as seen in FIG. 6.

Figure 8:
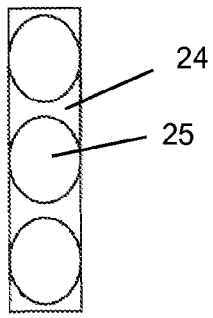
FIG. 8 shows a front view of one of the rows of multiple diffusion curved metering film cooling holes of the present invention at an angle normal to the airfoil surface in FIG. 7.
Figure 9:
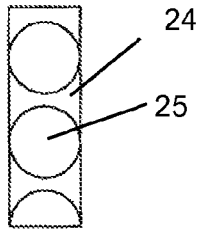
FIG. 9 shows a front view of one of the rows of multiple diffusion curved metering film cooling holes of the present invention at an angle parallel to the partition ribs that separate adjacent diffusion slots in FIG. 7.

FIG. 8 shows three diffusion holes 25 opening into the diffusion slot 24 with a view in a direction parallel to the angled ribs 28. FIG. 9 shows three diffusion holes 25 along a line of sight normal to the airfoil surface of the leading edge. Because of the diffusion hole 25 being angled with respect to the airfoil surface, the hole is not circular but elliptical with the hole height being greater than the hole width. A width of the conical shaped diffusion holes 25 is equal to a width of the diffusion slot 24 as seen in FIGS. 8 and 9.

The multiple diffusion with curved metering holes of the present invention is constructed in a small module formation. Individual modules are designed based on gas side discharge pressure in both chordwise and spanwise directions as well as designed at a desire coolant flow distribution for the showerhead film rows. Metering diffusion film hole density and/or the diameter for each film cooling module can be altered within each film row in the spanwise direction as well as for the pressure side showerhead row versus suction side showerhead row in the chordwise direction for the control the cooling flow area, blockage, and pressure drop across the metering diffusion film hole. Typical film hole metering section relative to diffusion section angle is at the range of 90 to 120 degrees relative to each other. The first diffusion section can be a 2-D diffusion or 3-D diffusion (conical shape) prior discharge into a continuous small open slot for the 2nd diffusion. The individual small module can be constructed in a staggered or inline array among the showerhead rows. With this unique film cooling construction approach, maximize the usage of cooling air for a given airfoil inlet gas temperature and pressure profile is achieved.

The cooling air is metered through the curved diffusion film hole in each small individual diffusion module device. The curved section in-between the metering section and the 1st diffusion section changes the cooling air flow direction thus changes the cooling air momentum and forms a metering diffusion cooling mechanism. This change of cooling flow direction and built-in 1st diffusion within the film cooling hole allows the cooling air diffuse uniformly into a continuous slot and reduces the cooling air exit momentum. Coolant penetration into the gas path is thus minimized; yielding good build-up of the coolant sub-boundary layer next to the airfoil surface, better film coverage in the chordwise and spanwise directions for the airfoil leading edge region is achieved. Since the multi-diffusion module device utilizes the continuous discrete slot approach instead of individual film hole on the airfoil surface, stress concentration is thus minimized.

In addition to better control of coolant flow, enhanced leading edge film cooling, and minimizes stress induced by the film holes, the change of cooling flow direction of cooling air in each individual metering and diffusion hole enhanced the heat transfer augmentation for the airfoil leading edge internal convection capability and the continuous discrete slots utilized for the showerhead rows reduce the amount of the hot gas surface thus translate to a reduction of airfoil total heat load into the airfoil leading edge region.

For the manufacture of this particular curved metering multi-diffusion film cooling slot, the conventional EDM drilling process will not able to form this complicated cooling slot geometry. The EDM drilling process for film cooling hole requires a straight line of sight between the film cooling inlet and exit. In order to fabricate a curved metering and multi-diffusion slot the metal printing process developed by Mikro Systems, Inc. or Charlottesville, Va. is used to form this complicated film cooling slot configuration. The 1st diffusion hole can be at very shallow angle i.e. less than 15 degrees, relative to the 2nd continuous discrete diffusion slot.

In operation, cooling air is supplied through the airfoil leading edge flow cavity 21, metered through the impingement holes 22, impinge cooling air onto the airfoil leading edge backside and diffuse the cooling air in the diffusion cavity 23. The spent cooling air is then further meter through the 1st section 26 of the curved metering diffusion film cooling hole then diffuse into the 2nd section 25 of the feed hole. Finally discharge the spent air into the continuous exit slots 24 for further diffusion prior discharge from airfoil and forming a film sub-layer for the cooling of airfoil leading edge region.

In summary, the new blade showerhead film slot or airfoil main body film slot arrangement of the present invention increases the blade showerhead film effectiveness to the level above the prior art straight showerhead achievable level and the curved flow phenomena through the film rows improves overall convection capability, lower the through wall thermal gradient, install more film holes per blade span height which reduces the blade leading edge or blade main body metal temperature.

I claim the following:

1. An air cooled turbine airfoil comprising:

a leading edge region;

a pressure side wall and a suction side wall extending from the leading edge region;

a leading edge region impingement cavity;

a row of metering and impingement holes opening into the leading edge region impingement cavity;

a row of diffusion slots opening onto a surface of the leading edge region of the airfoil;

a plurality of metering and diffusion holes connected to the leading edge region impingement cavity and opening into a diffusion slot;

an axis of the metering hole is at an angle to an axis of the diffusion hole;

the metering holes are angled in a radial downward direction; and, the diffusion holes are angled in a radial upward direction.

2. The air cooled turbine airfoil of claim 1, and further comprising:

the row of diffusion slots are separated by ribs that are angled in a radial upward direction of the airfoil.

3. The air cooled turbine airfoil of claim 1, and further comprising:

the row of diffusion slots form an opening with a radial height greater than a chordwise width of the slot.

4. The air cooled turbine airfoil of claim 1, and further comprising:

the metering holes are constant flow area holes; and, the diffusion holes are conical shaped holes.

5. The air cooled turbine airfoil of claim 1, and further comprising:

a width of an opening of the diffusion holes is equal to a width of the diffusion slot.

* * * * *